US011161683B2

(12) United States Patent
Rivard et al.

(10) Patent No.: US 11,161,683 B2
(45) Date of Patent: Nov. 2, 2021

(54) SANITATION SYSTEM

(71) Applicants: Renee Rivard, Provo, UT (US); Riley White, Phoenix, AZ (US)

(72) Inventors: Renee Rivard, Provo, UT (US); Riley White, Phoenix, AZ (US)

( * ) Notice: Subject to any disclaimer, the term of this patent is extended or adjusted under 35 U.S.C. 154(b) by 0 days.

(21) Appl. No.: 17/065,449

(22) Filed: Oct. 7, 2020

(65) Prior Publication Data

US 2021/0101740 A1 Apr. 8, 2021

Related U.S. Application Data

(60) Provisional application No. 62/911,584, filed on Oct. 7, 2019.

(51) Int. Cl.
*B65D 85/00* (2006.01)
*E03C 1/308* (2006.01)

(52) U.S. Cl.
CPC ..... *B65D 85/70* (2013.01); *E03C 1/308* (2013.01)

(58) Field of Classification Search
CPC ..... A45C 11/26; A47K 11/10; B65D 83/10; B65D 85/70; E03C 1/308; E03D 11/00
USPC ..... 206/349; D6/551
See application file for complete search history.

(56) References Cited

U.S. PATENT DOCUMENTS

| | | | | |
|---|---|---|---|---|
| 5,174,445 | A * | 12/1992 | Mull | A46B 15/00 15/143.1 |
| 5,456,356 | A | 10/1995 | Kurzawa | |
| D370,376 | S | 6/1996 | Mifsud | |
| D383,935 | S * | 9/1997 | Zawalsky | D6/524 |
| 5,727,280 | A * | 3/1998 | Romano | A46B 17/02 15/248.1 |
| 5,924,566 | A * | 7/1999 | Gibbs | A47K 17/00 206/361 |
| 6,038,709 | A | 3/2000 | Kent | |
| D457,277 | S | 5/2002 | Poston | |
| 6,719,134 | B2 | 4/2004 | Phillips et al. | |
| 7,806,256 | B2 * | 10/2010 | Wildauer | A47K 17/00 206/15.3 |
| 7,861,859 | B2 * | 1/2011 | Reynolds | A47K 17/00 206/349 |
| 9,970,186 | B2 | 5/2018 | Hodkiewicz | |
| 10,053,846 | B1 | 8/2018 | Rim et al. | |
| 10,098,514 | B2 | 10/2018 | Roll | |
| 10,801,195 | B2 * | 10/2020 | Morse | E03F 9/002 |
| 2009/0049593 | A1 | 2/2009 | Hodkiewicz | |
| 2018/0220860 | A1 | 8/2018 | Singer | |

FOREIGN PATENT DOCUMENTS

| | | | | |
|---|---|---|---|---|
| CA | 2838249 A1 * | 6/2014 | | E03C 1/308 |

* cited by examiner

*Primary Examiner* — Bryon P Gehman
(74) *Attorney, Agent, or Firm* — Amy Fiene PC

(57) ABSTRACT

A sanitation system includes a casing member having a top opening and a closed bottom and sidewalls that extend from the top opening to the closed bottom to form an interior compartment. The interior compartment is configured to receive a plunging instrument. The sanitation system may further include a container that holds the plunging instrument and the casing member. The container includes a vertical extension that extends vertically upward from the bottom of the container to be inserted within a bottom portion of the casing member and a cavity of the plunging instrument. Free ends of the casing member extend radially outward from the bottom of the container.

19 Claims, 14 Drawing Sheets

SANITATION SYSTEM

BACKGROUND

Plunging instruments offer an important means for removing waste material found in clogged toilets, sinks, and the like and restoring proper drainage and functionality. For example, the flexible head of a plunging instrument may be placed in a toilet over an outlet at the bottom of the toilet. The plunging instrument is forcibly pushed down and up over the outlet, creating a pumping motion, vacuum, and pressure in the outlet which loosens the clogged waste material and allows free flow through the outlet.

Because plunging instrument heads provide suction through a vacuum, they have a tendency to pull and trap matter therein and generally require cleaning after use to remove the matter. Human aversion naturally arises toward contacting the matter which often includes a pungent odor.

BRIEF DESCRIPTION OF THE DRAWINGS

The accompanying drawings illustrate various examples of the principles described herein and are part of the specification. The illustrated examples are given merely for illustration, and do not limit the scope of the claims.

DETAILED DESCRIPTION

Figure 1:
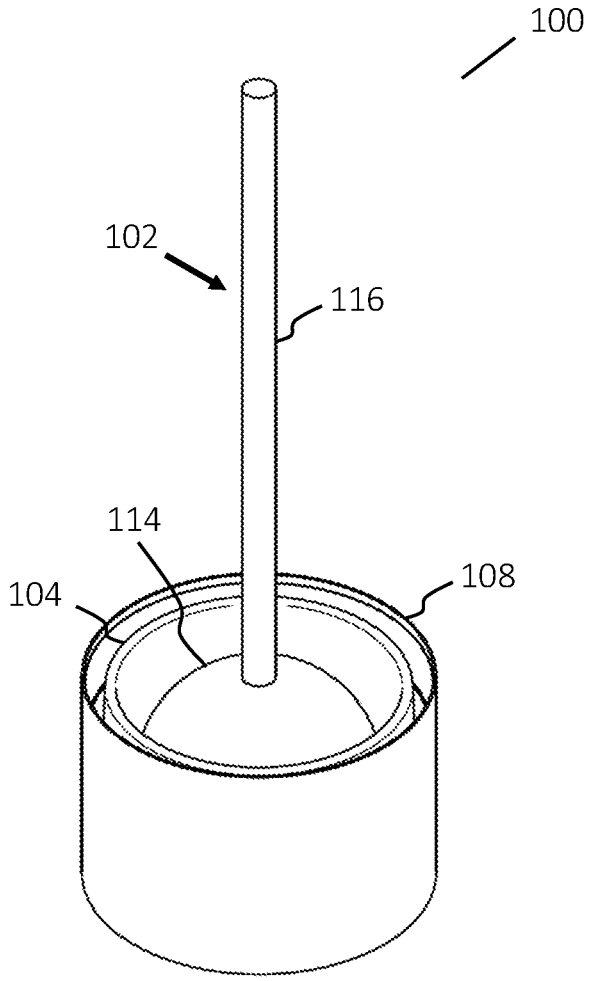
FIG. 1 illustrates a perspective view of an exemplary sanitation system.

The following relates to a sanitation system that provides protection for a plunging instrument for uses in various industrial and household environments such that the plunging instrument can be used multiple times without cleaning the plunging instrument in between uses.

The assembly includes a casing member, a container that holds the casing member, and a holder for holding the casing member and container. A plunging instrument may also be inserted within the container for storing the plunging instrument. Multiple layers of casing members may be stored in the container underneath the plunging instrument to provide multiple uses of the plunging instrument. This allows the plunging instrument and each casing member to be assembled together.

For a use with multiple casing members, the top most casing member is wrapped around the plunger head and a portion of the handle of the plunging instrument. The plunging instrument and casing member are then removed from the container and the casing member is used with the plunging instrument to protect the plunging instrument in use. After use, the used casing member is disposed of and the plunging instrument is placed in the container to apply a new, unused casing member. For each additional use, the plunging instrument is inserted back within the container for a casing member to be attached to the plunging instrument.

The arrangement of the plunging instrument, casing member, and container may all be contained within the holder for storage purposes. In another example, a portable arrangement includes a vertical extension having a hollow interior for holding and supplying casing members for a plunging instrument. The vertical extension is used to apply each casing member around the plunging instrument for use.

An exemplary sanitation system includes a casing member having a top opening and a closed bottom and sidewalls that extend from the top opening to the closed bottom to form an interior compartment. The interior compartment is configured to receive a plunging instrument. The closed bottom includes dimensions such that a portion of the closed bottom can be received within a cavity of the plunging instrument and conform to interior walls of the cavity.

An exemplary sanitation system further includes a container that holds the plunging instrument and the casing member. The container is defined by sidewalls that extend vertically upward from a base. The container includes a vertical extension that extends vertically upward from the base. At least one casing member and the plunging instrument are to be stacked on top of each other on the vertical extension. The vertical extension is to be received within a bottom portion of the casing member such that the vertical extension and the bottom portion of the casing member are received within a cavity of the plunging instrument. The sidewalls of the bottom portion of the casing member follow contours of the vertical extension. Free ends of the casing member extend radially outward from the bottom of the container.

Variations further include a holder that is dimensioned for a container to rest within for storage purposes.

Turning to FIG. 1, an example sanitation system 100 is shown, which includes a casing member 104 nested within a container 106 (see FIG. 3) which is nested within a holder 108. The casing member 104 is an elongate, flexible bag with an interior space as defined by a bottom and sidewalls and a top opening. The sidewalls are dimensioned to conform to the interior shape of the container 106. The container 106 is a holding structure with a bottom and vertical sidewalls and top opening. The casing member 104 and container 106 are nested within the holder 108. A plunging instrument 102 is stacked on top of the casing member 104 and holder 108 arrangement. The plunging instrument 102 includes an elongated handle 116 and a plunger head 114 at an end of the elongated handle 116.

The casing member 104 is removed from the container 106 by grasping edges of the casing member 104 and lifting the sidewalls of the casing member 104 out of the container 106. As a user lifts free ends of the casing member 104, the user can wrap the sidewalls of the casing member 104 around the handle 116 of the plunging instrument 102. The user can then remove the plunging instrument 102 together with the casing member 104. The user can then use the plunging instrument 102 with the casing member 104 for use in cleaning. After use, the casing member 104 is easily pulled off the plunging instrument 102 for easy disposal.

Multiple casing members 104 may be stacked in layers on the container 106, each casing member 104 conforming to the interior structure in a manner that each individual casing member 104 is removed in turn starting with the highest casing member 104 on the stack. Each casing member 104 is lifted toward the proximal end of the plunging instrument 102 to encase the plunger head 114 and at least a portion of the handle 116 of the plunging instrument 102. The user may then lift the plunging instrument 102 from the container 106 and holder 108. In use, the user may grasp sidewalls of the casing member 104 around the handle 116 of the plunging instrument 102 while making plunging motions and maneuvering. The casing member 104 may be removed after use by lowering free ends of the casing member 104 downward off the plunging instrument 102. The casing member 104 may then be easily disposed of. The plunging instrument is thus protected by the casing member 104 such that the user does not have to wash the plunging instrument 102 after use.

Turning to FIGS. 2*a*-2*g*, a set of casing members 204-1, -2, -3, -4, -5 are shown to illustrate a variety of shapes that can be used with a sanitation system 100.

Figure 2A:
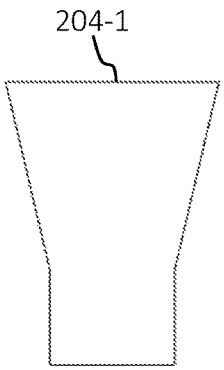
FIG. 2*a* illustrates a front view of an exemplary casing member.

Edges of the casing members 204-1, -2, -3, -4, -5 may be sealed before use. The sidewalls may be straight or tapered or both. Tapered sidewalls with upper sides being wider than bottom sides allow a user easier access at the upper sides for removing the bag from the plunging instrument. FIG. 2*a* shows a casing member 204-1 with sidewalls that taper radially inward from top to bottom so as to be wider at the top opening relative to the closed bottom. The bottom portion of the casing member defines a square or rectangle shape.

Figure 2B:
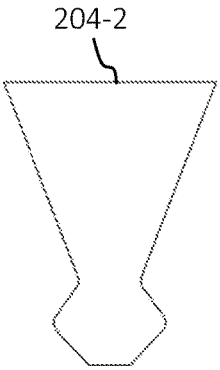
FIG. 2*b* illustrates a front view of an exemplary casing member.

FIG. 2*b* illustrates a bottom portion of the casing member 204-2 defining a hexagon shape.

Figure 2C:
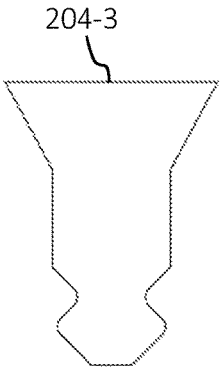
FIG. 2*c* illustrates a front view of an exemplary casing member.

FIG. 2*c* also illustrates a casing member 204-3 that has a hexagon shape. The sidewalls include an upper portion that is tapered, a central portion that is straight, and another tapered portion below the central portion. Various corners may be sharp or rounded and angles may vary according to desire. As shown, the bottom portion has edges with sharp corners and the upper corners of the hexagon shape are curved. The corners above the hexagon shape are sharp.

FIG. 2*c* also illustrates a casing member 204-3 that has a hexagon shape. The sidewalls include an upper portion that is tapered, a central portion that is straight, and another tapered portion below the central portion, a neck portion, and the hexagon-shaped bottom portion. Various corners may be sharp or rounded and angles may vary according to desire. As shown, the bottom portion has edges with sharp corners and the upper corners of the hexagon shape are curved. The corners above the hexagon shape are sharp.

Figure 2D:
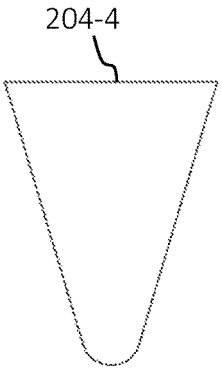
FIG. 2*d* illustrates a front view of an exemplary casing member.

FIG. 2*d* illustrates a casing member 204-4 that has a bottom portion with a rounded cup shape and that is defined by tapered sidewalls.

Figure 2E:
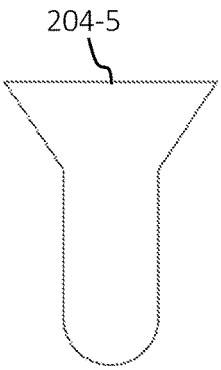
FIG. 2*e* illustrates a front view of an exemplary casing member.

FIG. 2*e* illustrates another variation of a casing member 204-5 that has a cup shape, as defined with middle sidewalls that are straight and an upper portion that tapers outward.

The length of the casing member from the top opening to the closed bottom may be approximately the length of a plunging instrument. The length may also be more or less than the length of the plunging instrument. The length of the sides of the casing member may extend anywhere along the length of the handle or past the handle of the plunging instrument. In an example, the casing member has sides with a length such that the sides of the casing member extend around the plunger head at the base of the handle of the plunging instrument where the top of the plunger head and the base of the handle intersect. In another example, the length of the side extend not more than ¼ to ½ the length of the handle.

The casing member may include an elastic or other type of resilient member to gather sides of the casing radially inward. Elastics, ties, clasps, or other materials may be used that pull and hold sides of the casing radially inward. Other locations are anticipated for the elastics or other materials, such as around a handle or on a side of the plunging instrument. In an example, an interior facing surface of the casing member includes adhesive properties that can be used to make the sides stick together and around the handle of a plunging instrument.

Figure 2F:
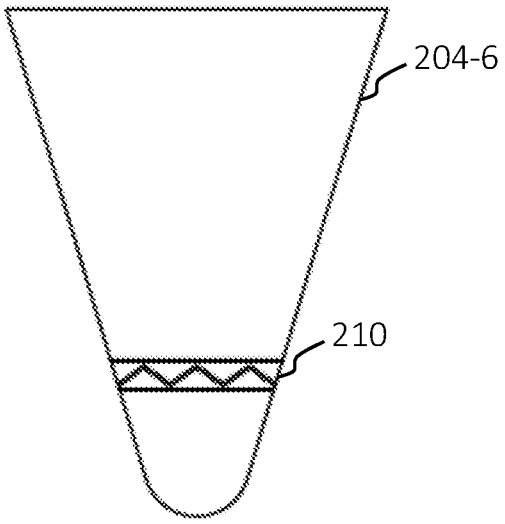
FIG. 2*f* illustrates a front view of an exemplary casing member.

As shown in FIG. 2*f*, the casing member 204-6 includes an elastic 210 or other type of resilient member to gather sides of the casing radially inward.

Figure 2G:
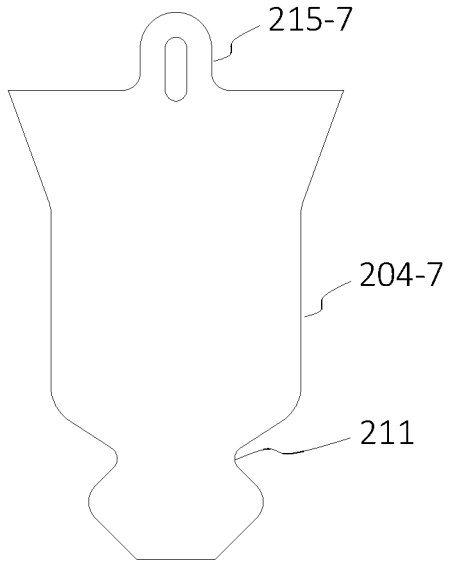
FIG. 2*g* illustrates a front view of an exemplary casing member.

FIG. 2*g* shows a variation of FIG. 2*b* in which the sides include a handle 215-7 provided by a hole in the casing member 204-7. There may be a handle 215-7 on either side of the casing member 24-7. Also, the handles 215-7 may be separate, independent members. Neck portion 211 is located between the hexa on-shaped bottom portion and the upper sidewalls, the neck portion 211 having a relatively narrower diameter than the hexagon-shaped bottom portion and the upper sidewalls.

Figure 2H:
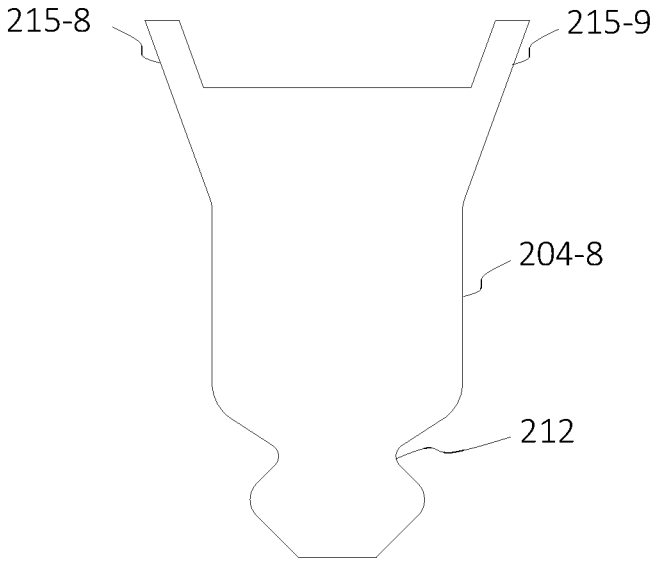
FIG. 2*h* illustrates a front view of an exemplary casing member.

FIG. 2*h* shows a variation of FIG. 2*b* in which the handles 215-8, 215-9 includes extensions outward from the side of the casing member 204-8. The handles 215-8, -9 extend parallel to the angled sides of the casing member 24-8. Handles 215-8, -9 provide manual handholds for a user in lifting or otherwise maneuvering the casing members 204-8. While two handles 215-8, -9 are shown, only one handle may be provided, or a plurality of handles may be provided. Neck portion 212 is located between the hexagon-shaped bottom portion and the upper sidewalls, the neck portion 212 having a relatively narrower diameter than the hexagon-shaped bottom portion and the upper sidewalls.

Figure 3:
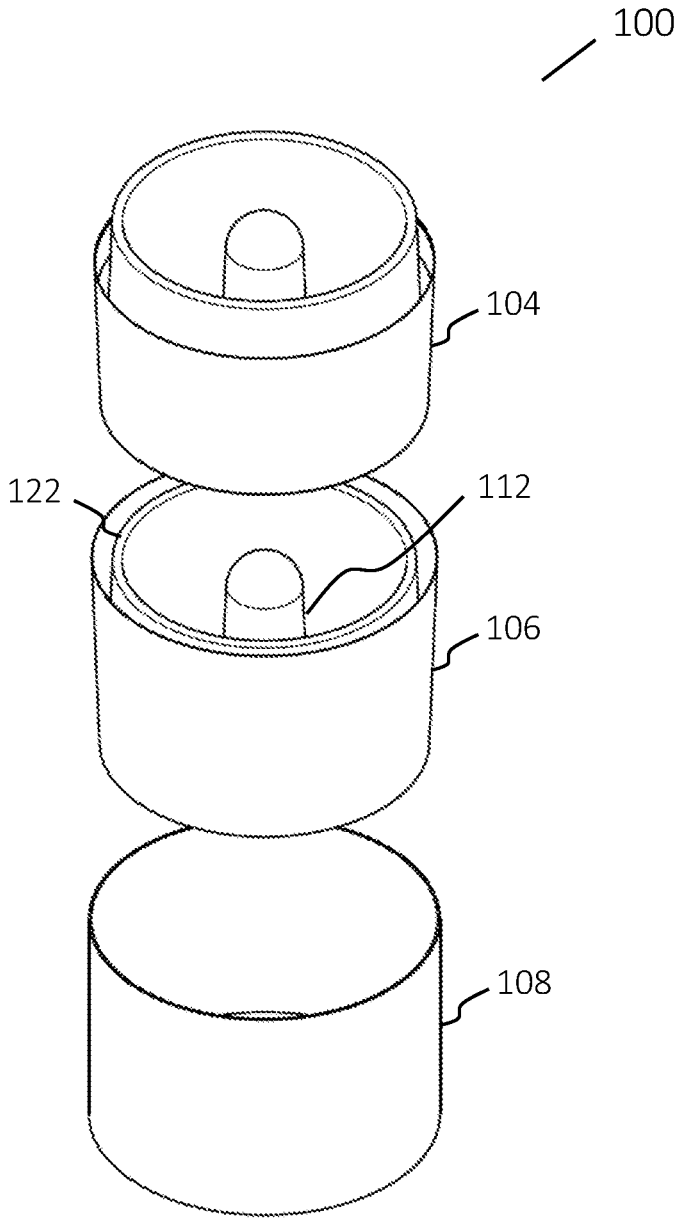
FIG. 3 illustrates an exploded view of a sanitation system including a casing member, container, and holder.

Turning to FIG. 3, an exploded view is shown of a casing member 104, container 106, and holder 108. The holder 108 includes a base with sidewalls extending vertically upward, the sidewalls and base defining a cavity in which the container 106, casing member 104, and plunging instrument 102 (see FIG. 1) are inserted. The cavity may be a cylindrical hollow or other volume that is dimensioned to receive the other members. The bottom of the cavity may be flat, slightly concave, convex, or other shape. The base may be weighted to keep it forced down to the ground. For example, the base may have a weighted bottom surface.

The container 106 includes annular sidewalls that extend vertically upward from edges of the bottom surface. A vertical extension 112 (see FIG. 3) extends vertically upward from a central position on the bottom surface. As shown, the vertical extension 112 may be centrally located on the bottom surface so as to have equidistant spacing radially outward. The vertical extension 112 is used to align the bottom center of the casing member 104 and plunging instrument 102. The vertical extension 112 is then used to push the bottom center of the casing member 104 into the bottom cavity of a plunger head 114 of a plunging instrument 102.

The vertical extension 112 may include an elongate member or post which may be hollow or solid. The vertical extension 112 may be an extruded member or a separate independent member that is attached to the bottom. The top of the vertical extension 112 may be flat with sharp or rounded edges. The top may instead be rounded with a half spherical shape for a smooth fit within the cavity of the plunger head 114.

The height of the vertical extension 112 may be at or near a height of the annular outer sidewalls of the container 106. Alternatively, the vertical extension 112 may be at or below a height of the annular outer sidewalls of the container 106. Further examples include that the vertical extension 112 be above the height of the annular outer sidewalls. The height of the vertical extension 112 may also be at, below, or above the height of the interior annular walls 122.

The container 106 may be reusable to hold refills of new, unused casing members 104. In another example, the container 106 is disposable so that it merely acts as a liner that is then disposed of and replaced after a time. Casing members 104 may come prepackaged on the disposable container 106 in a cartridge or unit type manner.

The casing member 104 may be folded or bent or otherwise configured to fit within and around contours of interior annular walls 122 and other interior surfaces of the container 106. The interior annular walls 122 are spaced a distance radially inward from the annular outer sidewalls and extend vertically from the bottom of the container 106. The interior annular walls 122 provide structure in which the casing member 104 is bent upwards and downwards to store the sides of the casing member 104 within the holder 106. The outer sidewalls of the holder 106 provide structure in which the sides of the casing member 104 are directed towards the top of the outer sidewalls for edges to be accessed by a user.

The closed bottom of the casing member 104 includes dimensions such that a portion of the closed bottom, including a portion of the bottom and sidewalls, can be received within and conform to interior walls of a cavity of the plunging instrument 102. When the bottom portion is being stacked on top of the vertical extension 112, the vertical extension 112 includes stiffness properties such that it pushes the bottom portion into the cavity of the plunging instrument 102 and around inner walls of the cavity of the plunging instrument 102.

A variety of plunging instruments may be covered, such as a cup plunging instrument with a classic wooden handle. A covering may also be used with a flange plunging instrument that includes a unique design characterized by a narrow flange or opening. The less common bellows plunging instrument may also be covered which includes a spring-like head and multiple pleats like an accordion to give it extra plunging power.

FIGS. 4-8 illustrate various casing members conforming to cavities within various plunging instruments.

Figure 4:
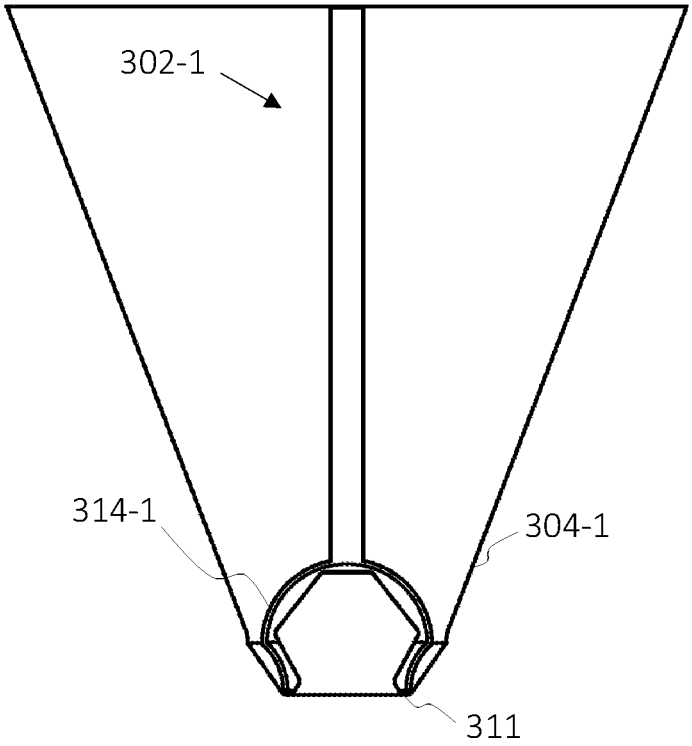
FIG. 4 illustrates a cutout view of a casing member and plunging instrument.

FIG. 4 illustrates a hexagon-shaped casing member like shown in FIGS. 2*b* and 2*c* used with a plunger head 314-1 on plunging instrument 302-1. The hexagon-shaped bottom portion is to be inverted to be received within a substantially spherical interior cavity of the plunger head 314-1 up to the neck portion 311. The hexagon shape may be a shape that works for multiple plunger applications, such as plungers used in households and plungers used in industrial buildings. When the casing member 304-1 is closer to the interior of the plunger head 114, there is a reduced chance that there will be air trapped in the space between the casing member 304-1 and the plunger head 114. The space can be seen during use. For example, if air is trapped, there will be a reduction of plunging efficiency as the casing member 304-1 has more space to move as the plunging motion is conducted. Also, the casing member 304-1 has an increased chance of popping with more space in between the casing member 304-1 and the plunger head 114. The casing member 304-1 may stretch more during movement causing it to pop.

Figure 5:
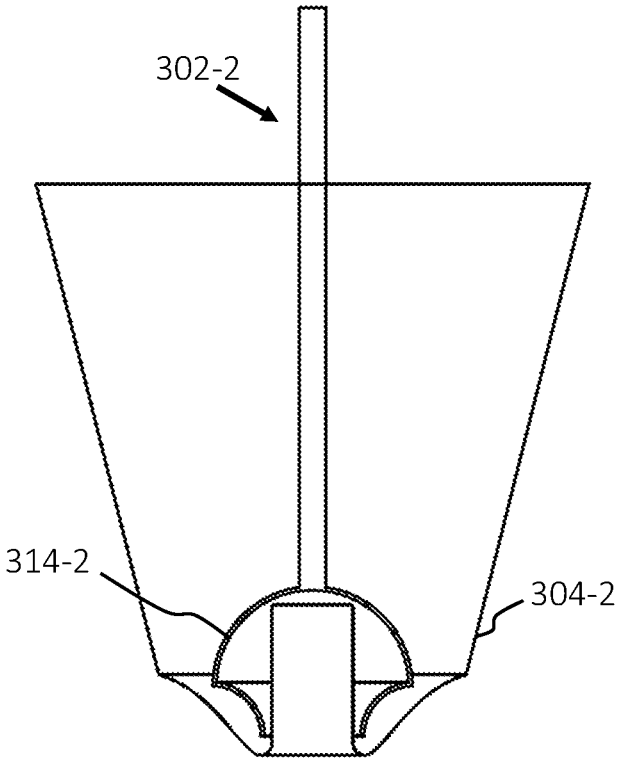
FIG. 5 illustrates a cutout view of a casing member and plunging instrument.

FIG. 5 illustrates a rectangular shaped casing member 304-2 used with plunger head 314-2 on plunging instrument 302-2. This may be useful, for example, when the vertical extension has a square or rectangular cross-section.

Figure 6:
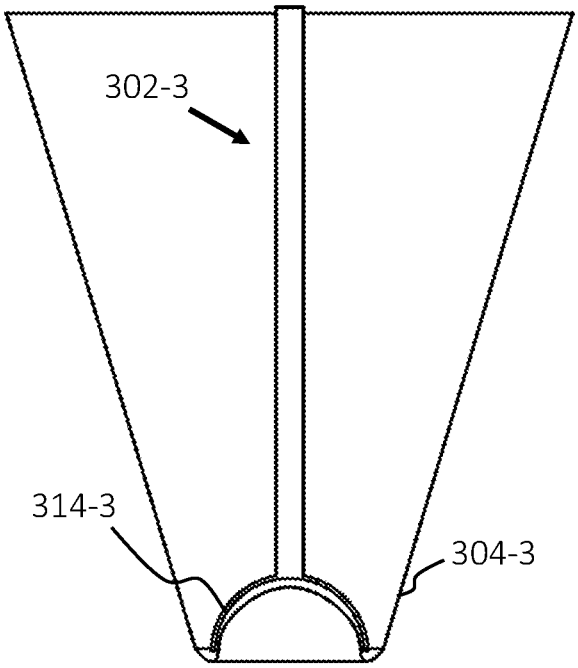
FIG. 6 illustrates a cutout view of a casing member and plunging instrument.

FIG. 6 illustrates a rounded casing member 304-3 used with plunger head 314-3 on plunging instrument 302-3. The curved spaces of the plunger head 314-3 and casing member 304-3 may be virtually in alignment.

Figure 7:
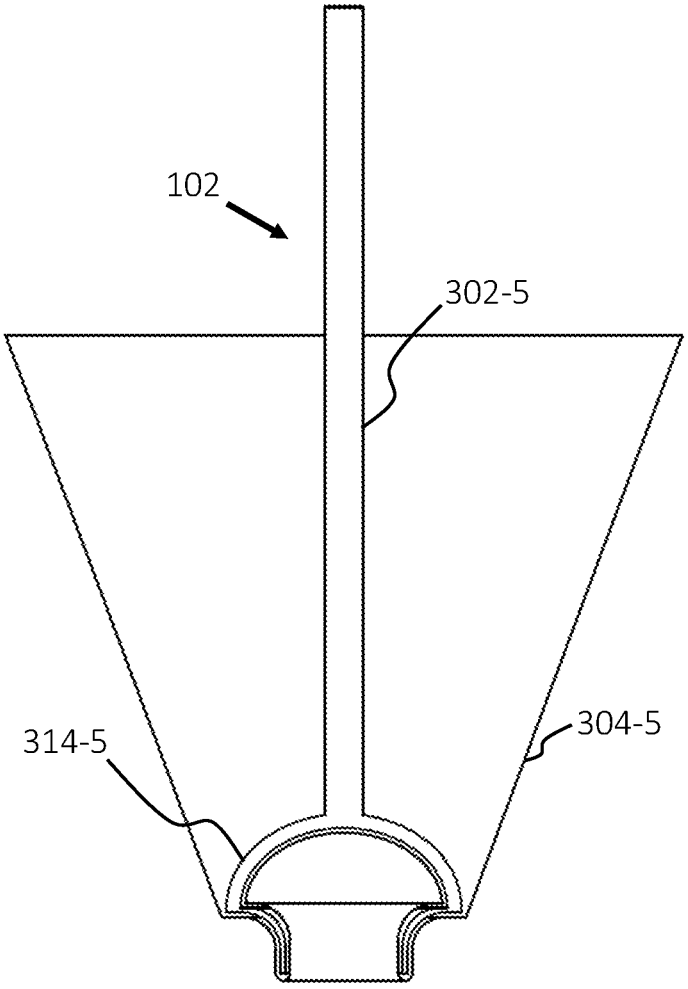
FIG. 7 illustrates a cutout view of a casing member and plunging instrument.

FIG. 7 shows a casing member 304-5 that follows the shape of a plunger head 314-5 that has a concave shape and a curvature with straight lower sides. For storage and use, a portion of the closed bottom of the casing member 104 is to be received within and conform to interior walls of a cavity of the plunger head 114 of the plunging instrument 102.

Figure 8:
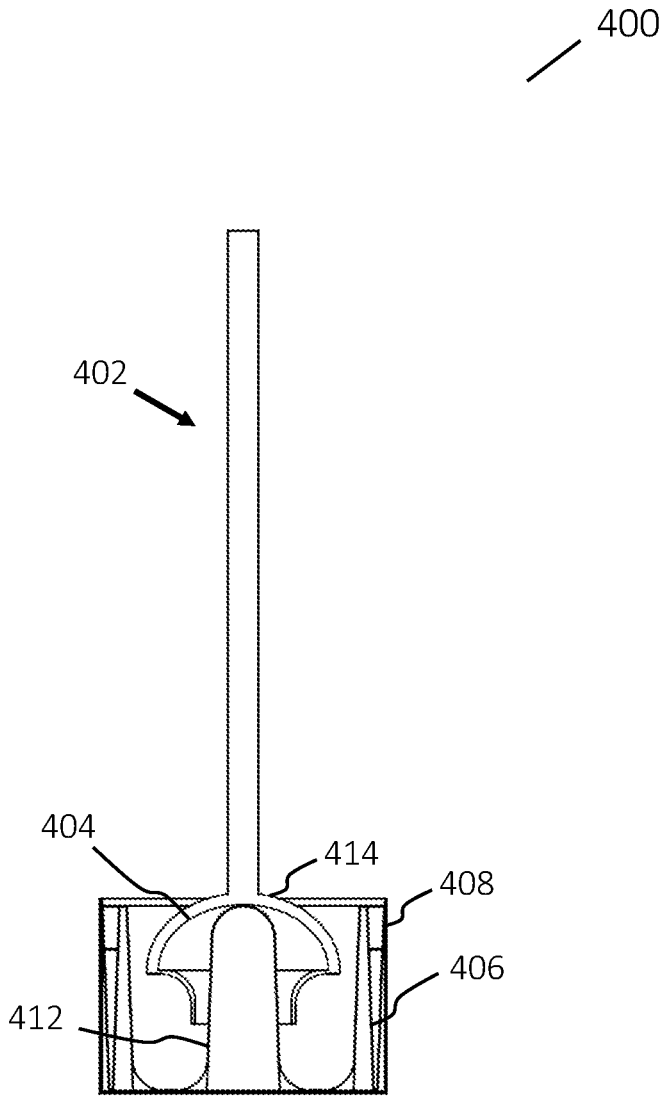
FIG. 8 illustrates a cutout view of a casing member, plunging instrument, a container, and a holder.

FIG. 8 illustrates a container 406 that holds a casing member 404 and a plunging instrument 402 with the casing member 404 conforming to a cavity of the plunger head 414 of the plunging instrument 402. The container 406 may cause the casing member 404 to conform to the cavity of the plunger 414 head of the plunging instrument 402. As shown, the container 406 includes a vertical extension 412 in the center that is used to push the center of the casing member 404 into the cavity of the plunging instrument 402. The vertical extension 412 is shown with a rounded top surface. A plunging motion when attached the plunging instrument 402 to the container 406 helps to create suction with the plunging instrument 402 to cause the casing member 404 to conform to the cavity of the plunger head 414. The top of the vertical extension 412 is rounded or otherwise curved for pushing the casing member 404 to the rounded top of the cavity of the plunger head 414.

Figure 9:
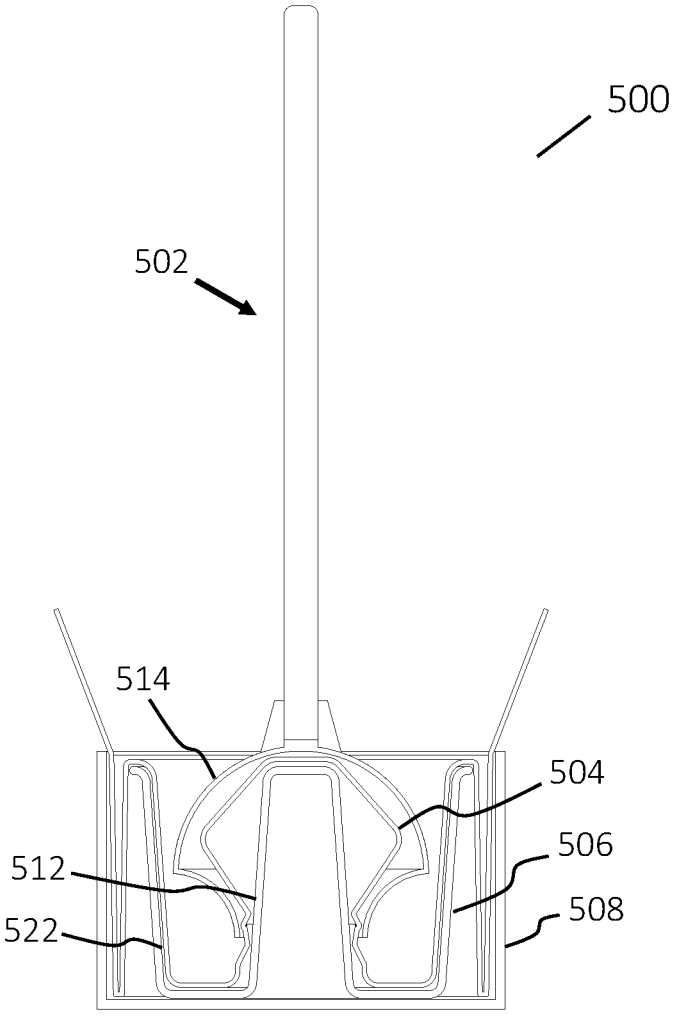
FIG. 9 illustrates a cutout view of a casing member, plunging instrument, a container, and a holder.

FIG. 9 illustrates another example according to principles herein of a container 506 that holds a casing member 504. The interior annular sidewalls 522 extend upwards and are slanted radially outward. The top of the sidewalls 522 curve outward and horizontally. The sides of the casing member 504 follow the slant and the curve to wrap around the sidewalls 522 and then extend downward to the bottom of the holder 508. At the bottom of the holder 508, the sides of the casing member 504 fold or otherwise bend back upwards to extend out of the holder 508.

The casing member 504 also conforms to a cavity of the plunger head 514 of the plunging instrument 502. As shown, the container 506 includes a vertical extension 512 in the center that pushes the center of the casing member 504 into the cavity of the plunger head 514 of the plunging instrument 502. The act of plunging and creating suction with the plunging instrument 502 when applying the casing member 504 to the container 506 causes the casing member to conform to the cavity of the plunger. The top of the vertical extension 512 is flattened or otherwise square for pushing the casing member 504 to a flat top of the cavity of the plunger head 514.

Figure 10:
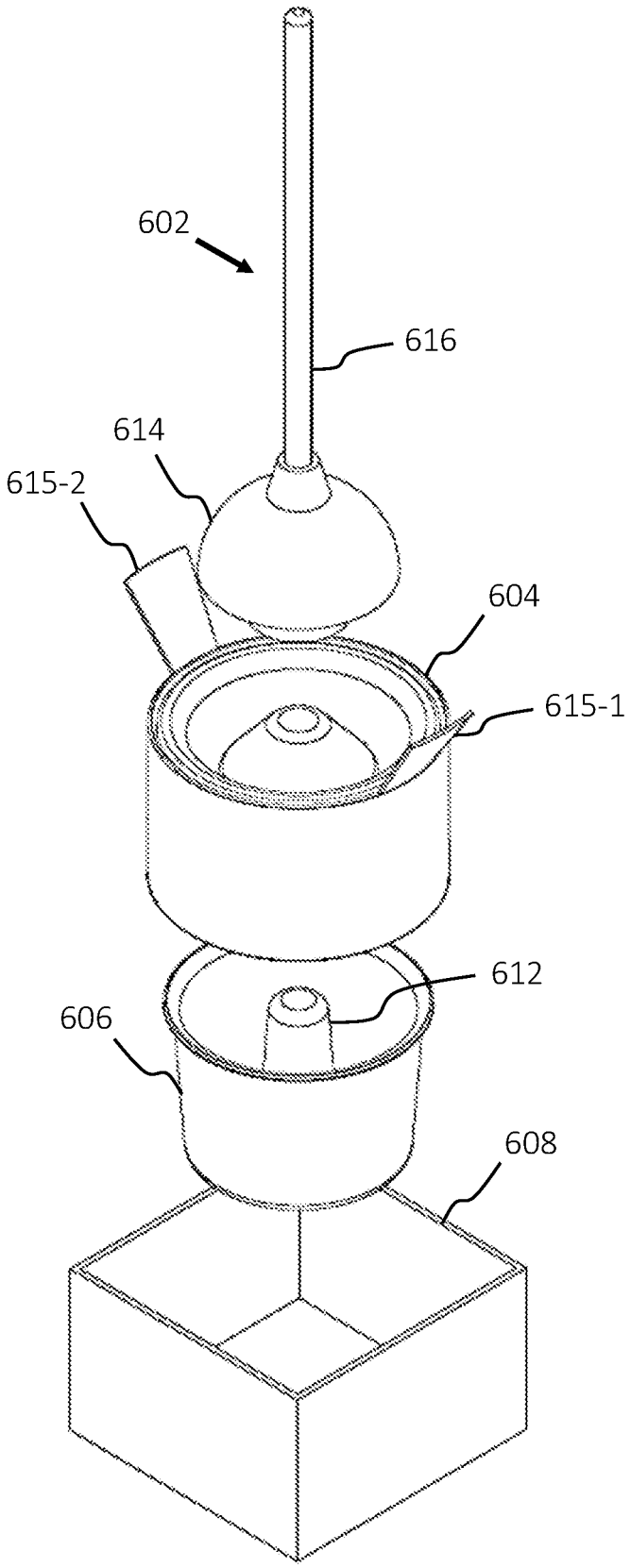
FIG. 10 illustrates an exploded view of a sanitation system including a casing member, container, and holder.

FIG. 10 illustrates a container 606, a casing member 604, plunging instrument 602, and holder 608. In this example, the holder 608 has a square shape that does not interfere with the shape of the round container 606. The casing member 604 includes handles 615-1, -2 that extend outward from sides of the casing member 604 and which are used to lift the casing member 604 and help wrap it around the plunger head 614 conform and otherwise secure it to the handle 616.

Note that the casing member 604 may have a tapered structure as shown that narrows radially inward from the bottom of the casing member 604. As the vertical extension 612 pushes the center of the casing member 604, the casing member 604 will conform to the interior cavity of the plunger head 614.

Figure 11:
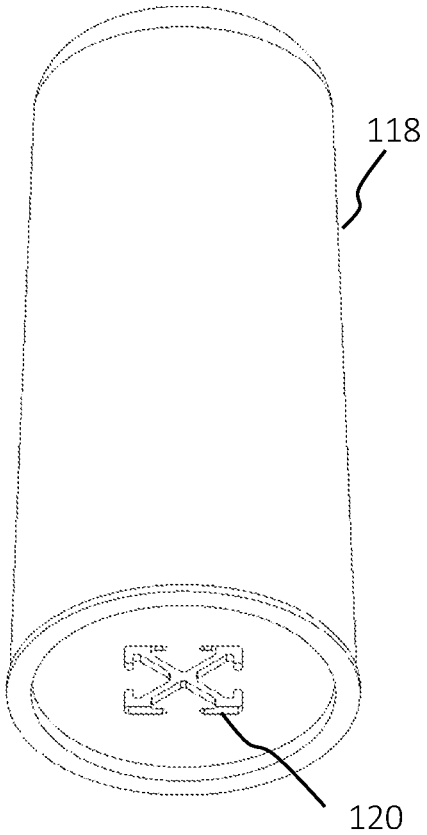
FIG. 11 illustrates a perspective view of a portable extension.
Figure 12:
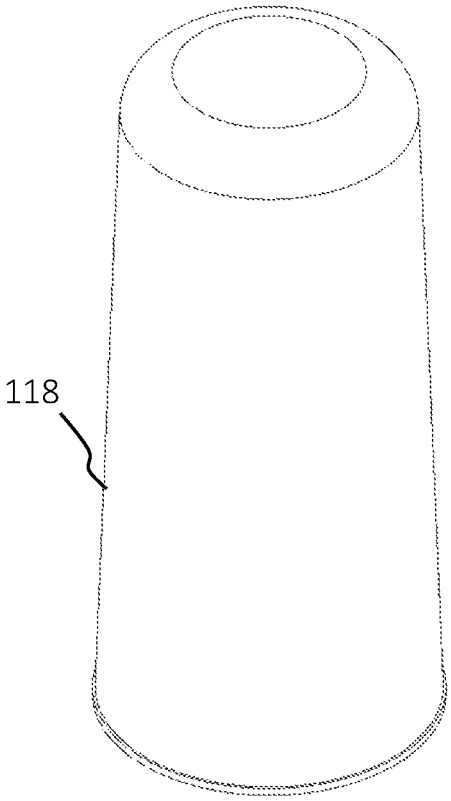
FIG. 12 illustrates a perspective view of a portable extension.

FIG. 11 illustrates a portable extension 118 that provides a vertical extension 112 without the rest of the container 106 or the holder 108. The portable extension 118 is useful for keeping the assembly compact, lightweight, and transferable from one location to another. The portable extension 118, like the vertical extension 112, includes an elongate member with a round or square flat top that is used to push the central bottom of the casing member 604 into a plunger head 114. The portable extension 118 includes a hollow interior with a bottom of the portable extension 118 including an opening, such as the crosswise opening 120 shown, that provides access to the opening. The material of the portable extension 118 and the bottom may be rigid, flexible, resilient, or otherwise allow the opening to expand or move to provide access.

Figure 13:
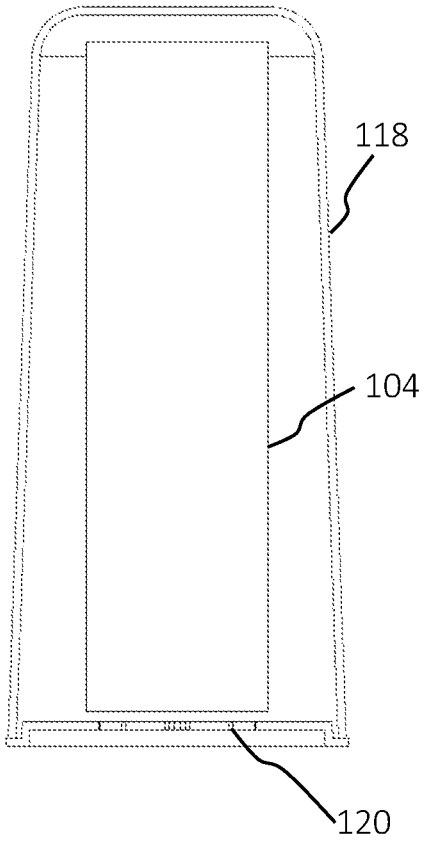
FIG. 13 illustrates a cutout view of a portable extension.

FIG. 13 shows a cross-section of the portable extension 118 with a space inside in which casing members 104 may be stored. In this manner, one casing member 104 may be removed at a time and used and then disposed of.

Materials of the sanitation system may vary. For example, one or more of the casing member, container, and holder may be made of one or more of a biodegradable, compostable material. The material may be one or more of plastic, synthetic, natural, cotton, metal, silicone, resin, plant, or other material.

The casing member may include properties that make the casing member biodegrade or otherwise decompose. This may include one or more of a material, layer, liquid, powder, spray, or other component on the inner cavity of the casing member that causes the casing member to biodegrade or decompose.

While this invention has been described with reference to certain specific embodiments and examples, it will be recognized by those skilled in the art that many variations are possible without departing from the scope and spirit of this invention, and that the invention, as described by the claims, is intended to cover all changes and modifications of the invention which do not depart from the spirit of the invention.

What is claimed is:

1. A sanitation system comprising:

a casing member having a top opening and a closed bottom, sidewalls that extend from the top opening to the closed bottom to form an interior compartment, the interior compartment configured to receive a plunging instrument, and a container defined by sidewalls that extend vertically upward from a base and a vertical extension that extends vertically upward from the base, the casing member and the plunging instrument to be stacked on top of each other on the vertical extension, the vertical extension to be received within a bottom portion of the casing member, the vertical extension and bottom portion to be received within a cavity of the plunging instrument, the sidewalls of the casing member to follow contours of the vertical extension, free ends of the casing member to extend radially outward from the bottom of the container.

2. The sanitation system of claim 1, the container further including an annular wall that extends vertically upward between the vertical extension and outer walls of the container, the annular wall configured so that an end portion of the casing member may be inserted within a space between the annular wall and the outer walls of the container, free ends of the end portion extending upward so as to be available for raising sidewalls of the casing member vertically upward and around the plunging instrument.

3. The sanitation system of claim 2, wherein the annular wall extends vertically upward to a height that is at or near a height of the vertical extension.

4. The sanitation system of claim 2, wherein the annular wall is located radially closer to the outer walls than to the vertical extension.

5. The sanitation system of claim 1, further comprising a holder that defines a cavity in which the container may be inserted.

6. The sanitation system of claim 1, wherein the container is disposable.

7. The sanitation system of claim 1, wherein the closed bottom of the casing member includes dimensions such that a portion of the closed bottom can be received within and conform to interior walls of a cavity of the plunging instrument.

8. The sanitation system of claim 1, wherein the bottom portion being stacked on top of the vertical extension pushes the bottom portion into the cavity of the plunging instrument and around inner walls of the cavity.

9. The sanitation system of claim 1, wherein the vertical extension has a rounded top.

10. The sanitation system of claim 1, wherein the casing member is made of a biodegradable material.

11. The sanitation system of claim 10, wherein the casing member includes one or more of a material, layer, liquid, powder, spray, and other component on the inner cavity of the casing member that causes the casing member to biodegrade.

12. The sanitation system of claim 1, further comprising one or more properties that make the casing member biodegrade.

13. A flexible casing member for a sanitation system comprising:

a top opening and a closed bottom defined by sidewalls that extend from the top opening to the closed bottom to form an interior compartment having a hexagon-shaped bottom portion, the sidewalls having upper sidewalls that taper so as to be wider at the top opening relative to the closed bottom, the sidewalls further having a neck portion between the hexagon-shaped bottom portion and the upper sidewalls, the neck portion tapering from the upper sidewalls to a diameter that is relatively narrower than the hexagon-shaped bottom portion and the upper sidewalls, the neck portion then tapering outward to the hexagon-shaped bottom portion, the hexagon-shaped bottom portion to be inverted to be received up to the neck portion within a substantially spherical interior cavity of a plunger head of a plunging instrument, the hexagon-shaped bottom portion dimensioned to conform to interior walls of the cavity and thereby reduce air being trapped between the casing member and the plunging instrument, the neck portion having a substantially same diameter as an opening of the cavity to thereby allow an opening for plunging action that is substantially the same as a plunging instrument without the casing member, the upper sidewalls to extend from the opening of the cavity and taper outward and toward a top of a handle of the plunging instrument and thereby encase and protect at least a portion of an exterior of the plunging instrument.

14. The sanitation system of claim 13, wherein a bottom portion of the casing member defines a square or rectangle shape.

15. The sanitation system of claim 13, wherein a bottom portion of the casing member defines a hexagon shape.

16. The sanitation system of claim 13, wherein a bottom portion of the casing member defines a rounded cup shape.

17. The sanitation system of claim 13, wherein a bottom portion of the casing member defines a rounded cup shape with sides of the cup shape being tapered.

18. The sanitation system of claim 13, further comprising an elastic that gathers sides of the casing radially inward.

19. A sanitation system comprising:

a casing member having a top opening, a neck portion, sidewalls, and a closed bottom, a bottom portion of the casing member having a hexagon shape, the bottom portion dimensioned to be received up to the neck portion within a concave interior of a plunger head of a plunging instrument, corner edges of the hexagon shape dimensioned to contact interior walls of the concave interior and thereby reduce air being trapped between the casing member and the plunging instrument, the bottom portion further dimensioned to be received within a container, the container defined by sidewalls that extend vertically upward from a base and a vertical extension that extends vertically upward from the base, the casing member and the plunging instrument to be stacked on top of each other on the vertical extension, the vertical extension to be received within a bottom portion of the casing member, the vertical extension and bottom portion to be received within a cavity of the plunging instrument, the sidewalls of the casing member to follow contours of the vertical extension, free ends of the casing member tapering upward and outward from the bottom of the container.

* * * * *